US010576648B2

(12) United States Patent
Efthimiadis

(10) Patent No.: US 10,576,648 B2
(45) Date of Patent: Mar. 3, 2020

(54) SHAVER HANDLE WITH A LOCK AND RELEASE MECHANISM FOR ENGAGING AND DISENGAGING A RAZOR CARTRIDGE

(71) Applicant: BIC-VIOLEX S.A., Anixi (GR)

(72) Inventor: Dimitrios Efthimiadis, Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 16/080,058

(22) PCT Filed: Apr. 5, 2016

(86) PCT No.: PCT/EP2016/057448
§ 371 (c)(1),
(2) Date: Aug. 27, 2018

(87) PCT Pub. No.: WO2017/174120
PCT Pub. Date: Oct. 12, 2017

(65) Prior Publication Data
US 2019/0061186 A1 Feb. 28, 2019

(51) Int. Cl.
*B26B 21/52* (2006.01)

(52) U.S. Cl.
CPC ..... *B26B 21/521* (2013.01)

(58) Field of Classification Search
CPC ..... B26B 21/14; B26B 21/52; B26B 21/225; B26B 21/521; B26B 21/522
USPC ..... 30/526, 532
See application file for complete search history.

(56) References Cited

U.S. PATENT DOCUMENTS 4,083,104 A * 4/1978 Nissen ..... B26B 21/50 30/47
4,198,746 A * 4/1980 Trotta ..... B26B 21/225 30/29
4,227,302 A 10/1980 Torrance
4,266,340 A * 5/1981 Bowman ..... B26B 21/225 30/47
4,739,553 A * 4/1988 Lazarchik ..... B26B 21/521 30/47

(Continued)

FOREIGN PATENT DOCUMENTS

EP 0 020 815 A1 1/1981
EP 0 195 602 A2 9/1986

(Continued)

OTHER PUBLICATIONS

International Search Report for PCT/EP2016/057448 dated Nov. 24, 2016.

*Primary Examiner* — Hwei-Siu C Payer
(74) *Attorney, Agent, or Firm* — Polsinelli PC

(57) ABSTRACT

A handle for a shaving razor adapted to releasably engage with a razor cartridge. The handle includes a handle body, a support, a pair of arms movably mounted on the support and adapted to engage the cartridge when the arms are in a lock position, and to disengage the cartridge when the arms are in a release position, each of the arms extending in a forward direction. The support further includes a pair of arcuate guides and the arms are slidably mounted along the arcuate guides, such that the arms are turned toward and away from the lock position when sliding along a forward/backward direction. The arms are driven by a driving member, which is slidably mounted on the support between the arms.

14 Claims, 4 Drawing Sheets

(56) References Cited

U.S. PATENT DOCUMENTS

| | | | | |
|---|---|---|---|---|
| 4,756,082 | A * | 7/1988 | Apprille, Jr. | B26B 21/225 30/530 |
| 5,044,077 | A | 9/1991 | Ferraro et al. | |
| 9,757,870 | B2 * | 9/2017 | Giannopoulos | B26B 21/222 |
| 2002/0116831 | A1 * | 8/2002 | Coffin | B26B 21/225 30/526 |
| 2011/0023310 | A1 * | 2/2011 | Psimadas | B26B 21/225 30/526 |
| 2011/0167653 | A1 * | 7/2011 | Psimadas | B26B 21/222 30/526 |
| 2015/0321366 | A1 * | 11/2015 | Papadopoulos-Papageorgis | B26B 21/222 30/532 |
| 2017/0036363 | A1 * | 2/2017 | Efthimiadis | B26B 21/52 |
| 2017/0334083 | A1 * | 11/2017 | Gratsias | B26B 21/521 |
| 2019/0061186 | A1 * | 2/2019 | Efthimiadis | B26B 21/521 |

FOREIGN PATENT DOCUMENTS

| | | | |
|---|---|---|---|
| GB | 2 078 589 A | * | 1/1982 |
| GB | 2 086 790 A | | 5/1982 |

* cited by examiner

SHAVER HANDLE WITH A LOCK AND RELEASE MECHANISM FOR ENGAGING AND DISENGAGING A RAZOR CARTRIDGE

CROSS REFERENCE TO RELATED APPLICATION

This application is a National Stage application of International Application No. PCT/EP2016/057448, filed on Apr. 5, 2016, the entire contents of which is incorporated herein by reference.

FIELD

The disclosure relates to wet shaving razors including a razor handle with a release mechanism for engaging and disengaging disposable razor cartridges and method of manufacture such razors.

BACKGROUND

Conventionally shavers having a lock & release mechanism are operated by a push button. The lock & release mechanism often includes a button that interacts with a pair of arms mounted for movement towards and away from each other to engage and disengage a replaceable blade cartridge.

SUMMARY

The handle for a shaving razor according to the present disclosure is adapted to releasably engage with a razor cartridge. More specifically, the present disclosure is related to a handle for a shaving razor adapted to releasably engage with a razor cartridge, said handle including: a handle body, a support, a pair of arms movably mounted on the support between a lock position and a release position and elastically biased toward the lock position, the pair of arms are adapted to engage the cartridge when the arms are in a lock position, and to disengage the cartridge when the arms are in a release position, each of the arms extending from a proximate end of the handle closer to the support to a distal end of the handle further away from the support. The support further includes a pair of arcuate guides and the arms are slidably mounted along the arcuate guides, the arcuate guides being shaped so that sliding the arms in the first direction turns the arcuate guides toward the lock position, and sliding the arms in a second direction opposite to the first direction turns the arcuate guides toward the release position.

The support further includes a pair of arcuate guides and the arms are slidably mounted along the arcuate guides, the arcuate guides being shaped so that sliding the arms in the first direction turns the arcuate guides toward the lock position, and sliding the arms in a second direction opposite to the first direction turns the arcuate guide toward the release position.

The handle further includes a driving member which is slidably mounted on the support between the arms and which is connected to the arms such that sliding the driving member in the first direction moves the arms towards the distal end of the handle on the arcuate guides and turns them toward the lock position, and sliding the driving member in the second direction moves the arms towards the proximate end of the handle on the arcuate guides and turns the arcuate guides toward the release position.

According to an aspect of the embodiments, the first direction corresponds to a forward direction substantially along the longitudinal axis of the handle towards the distal end thereof, and the second direction corresponds to a backward direction substantially along the same longitudinal axis of the handle towards the proximate end thereof.

The lock and release mechanism according to the present disclosure offers an increased safety for the user, when manipulating the shaving cartridge, when using the cartridge for shaving as well as during engagement/disengagement of the cartridge. For this purpose, the arms are slidably mounted along the arcuate guides and are adapted to be either pushed towards the distal end of the handle or pulled towards the proximate end of the handle by the driving member. The combination of the driving forces of the driving member applied in the first or second direction with the presence of the arcuate guides gives rise to a specific movement of the arms having various advantages. More specifically, during the disengagement of the shaving cartridge the driving member pulls the arms in the second direction, thereby moving the arms in the release position. The presence of the arcuate guides makes the arms rotate around a center of rotation, corresponding with the center of curvature of the arcuate guides. Thus, the arms effectively perform a two-fold movement. First, as already mentioned the arms move towards the proximate end of the handle, such as for example, and second the arms move closer to each other in a direction substantially perpendicular to the movement along the second direction.

Analogically, when the arms are in the release position, they can be pushed in the first direction towards the distal end of the handle by the action of the driving member such as for example, in the forward direction). In this situation, the arms not only each move in the first direction but also move apart from each other as the driving member continues to move further in the first direction. This causes the arms to engage with a releasable cartridge. The above described configuration of movements is only possible, when the arcuate guides are provided on the handle.

The present disclosure aims to further improve the technology of holding the cartridge on the handle over the current prior art, especially in terms of increasing the attachment strength.

In conventional shavers, the arms of shavers having releasable cartridges—where the arms are adapted to hold the cartridge—are generally movable in a single direction, for example in the direction towards and away from each other, or the arms merely perform one type of movement, such as for example the rotational movement. The arms are elastically biased into the position in which they firmly hold the shaving cartridge, so that when no external forces are applied, the cartridge is attached comfortably on the handle. However, upon application of certain external forces, the cartridge can be disengaged from the cartridge with less force or minimal force. This can happen especially when the cartridge is pulled away from the handle. In such case, the pulling forces may overcome holding forces of the two arms, i.e. the biasing forces by which the arms are urged into the lock position, and the cartridge may be released with minimal force.

In order to improve the release force of the cartridge from the handle by pulling the cartridge away from the handle as described above, the handle of the present disclosure is provided with arcuate guides and driving member operating in mutual cooperation. This ensures that whenever the cartridge is being pulled away from the handle, the driving member is forced in a first direction (for example forward), thereby urging the arms even more in the direction away from each other and thus strengthening the locking function of the arms. Also, the higher the pulling force on the cartridge there is, the higher tendency of the arms to move apart emerges. In other words, the stronger the effort of the external forces to pull and/or release the cartridge from the handle, the more intense is the strength with which the cartridge is held on the handle.

The above effect is achieved by combining two types of movement of the lock and release mechanism, one of which is the sliding movement of the driving member and the other one being the rotational movement of the arms along the arcuate guides. Such effect cannot be achieved by using only one of the above two types of movements, and neither is possible to achieve it with the arms moving simply towards and away from each other, or at least in that case the effect would be greatly limited and not as effective as it could be.

Various embodiments of the present disclosure may be provided with one or more of the following features:

the two arms extend generally in a common plane (when the arms are positioned in a mutual angle different from the angle of 180 degree, the effect of mutual cooperation of the driving member and the arms could be diminished; therefore, the arms are designed to lie in a generally common plane);

the arms respectively include: a main body positioned generally between the handle body and the support, and shell bearings extending outside the handle and being adapted to engage with the cartridge;

the shell bearings extend generally away from each other in opposite directions and substantially perpendicularly to the forward direction, such that when the arms are moved towards the distal end of the handle along the arcuate guides the shell bearings move in the direction away from each other, and when the arms are moved towards the proximate end of the handle along the arcuate guides the shell bearings move in the direction towards to each other;

the arms and the arcuate guides have complementary surfaces facing each other enabling engagement of the arms with the arcuate guides, such that the main body of each arm keeps contact with the corresponding arcuate guide when it slides on the support (the arms and the arcuate guides are designed such that at each moment of their mutual relative movement, they maintain contact with each other via corresponding complementary surfaces; the movement of the arm is thus more stable and more properly led in the desired direction than in the situation when the arms are moving in a generally free space, or when for example the arms are only moving around one particular point in space such as during rotation around a pair of pins; when the entire main body of the arms is kept in contact with the arcuate guides, a smoother movement of the arms is achieved);

the handle includes a pair of channels in the support for receiving the main body of each respective arm, each channel providing guidance for the main body of each arm, when moving to and from the release position (the presence of the guiding channels is another advantageous arrangement in the structure of the lock and release mechanism of the handle, which allows for stable guidance of the arms along the arcuate guides; the movement of the arms is thus fixed and performed along predefined curves with enough precision and without any kind of loose movement, which could disturb the movement of the arms during use and also prevent proper long-term operation of the product;

each arm includes at least one recess adapted to receive a complementary projection, such that each arm is enabled to be pulled in the backward direction and pushed in the forward direction, the driving member has at a front end thereof, closer to the cartridge the pair of projections, each projection fitting into at least one recess of the corresponding arm (fitting the projections of the driving member in a pair of recesses of the arms aims to provide tight connection between the individual parts of the assembly and to prevent any wiggling of the arms and/or the driving member on the support during use; this way the arms are seated sufficiently tightly between the respective arcuate guide and the driving member, the arcuate guide preventing the wiggling motion on one side and the driving member preventing the wiggling motion on the other side;

the tip of the projection of the driving member may have any shape e.g. forming a linear pin, or in some instances can have a curved convex shape; the recess of each arm in which the corresponding projection is engaged may form a complement to the pin-like projection or having a suitable curved concave shape fitting with the convex projection (since the driving member is adapted to perform a linear motion in the first and second directions, while the arms both slide and rotate along the arcuate guides, it is desirable to provide the projections of the driving member with tips that are curved outwards, and to curve the recesses of the arms inward; this allows for smoother movement respecting the peculiarities of the present lock and release mechanism, which is characterized by combining the translational and rotational movements of two components of the lock and release mechanism;

the arms and the driving member are separate from the support, and each arm and the driving member are all separate from each other (by separating the components of the lock and release mechanism into several independent entities, it is ensured that no extra tension is created between any two of the components; therefore, an excessive strain of the material of the components largely minimized and in some case even entirely avoided);

the arcuate guides each have a center of curvature and the center of curvature of the arcuate guides lies outside the handle (it has been observed that by positioning the center of curvature of the arcuate guides outside the handle, one may reduce the spatial demands associated with the arcuate guides and the arms; in other words the arms and the arcuate guider require less space in the arrangement with the centers of curvature of the arcuate guides outside the handle in comparison to the situation when these centers are located inside the handle in an arbitrary directional arrangement);

the handle further includes a biasing means, the biasing means generating a return biasing force as the arms move towards the release position and as the driving member is moved in the second direction, the return biasing force urging the arms in the lock position by forcing the driving member in the first direction;

the handle includes a button adapted to be pressed downwards in a direction substantially perpendicular to a plane formed by the arms, the button being adapted to cooperate with the driving member, such that when the button is pressed downwards, the driving member is forced to move in the second direction by the button, thus moving the arms into the release position, and the biasing means forcing the driving member to move back in the first direction, thus moving the arms into the lock position, once the button is released by the user.

the driving member includes an inclined surface located at the back thereof, such that the button when actuated slides along the inclined surface, thereby forcing the driving member to slide in the second direction, such that the arms are moved in the release position;

the button can be in the form of an arbitrarily formed insert with the only limitation being that the button is adapted to slide along the surface of the inclined surface of the driving member; according to some aspects of the embodiments the button can have, for example, the shape of a sphere;

The disclosure further relates to a shaving razor including the handle according to one of the above embodiments, a cartridge mounted on the handle, at least the cartridge being engaged by the two arms when the two arms are in the lock position and at least the cartridge being disengaged from the two arms when the two arms are in the release position, at least the cartridge being released from the handle upon actuation of the button.

DETAILED DESCRIPTION

The following description of the main embodiments of the disclosure is made with reference to the accompanying drawings, where the same reference numbers denote identical or similar elements.

In the description, the XY plane is the plane where the pivot arms are located. The axis X as depicted on the drawings consists of two opposite directions, X1, X2. The same applies to the Y and Z axes with the directions of Y1, Y2 and Z1, Z2, respectively. The first direction is generally associated with the direction Y1. The direction Y1 corresponds to forward direction taken along the longitudinal direction of the handle, i.e. direction generally towards the shaving cartridge. The second direction, on the other hand is the direction opposite to the first direction and points along the axis Y2.

The direction Y2 corresponds to backward direction, i.e. generally in a direction away from the cartridge towards the proximate end of the handle. By reference to the illustrative embodiments on the drawings, the wording "first direction" and "forward direction" may be used interchangeably, being associated with the same meaning. The same applies for the "second direction" and "backward direction". The upper part of the handle is generally referred to as the side of the handle located above the XY plane (the side of the handle body with the opening 127), while the lower side of the handle is generally referred to as the side lying below the XY plane (the side where the support 104 is located).

Figure 1:
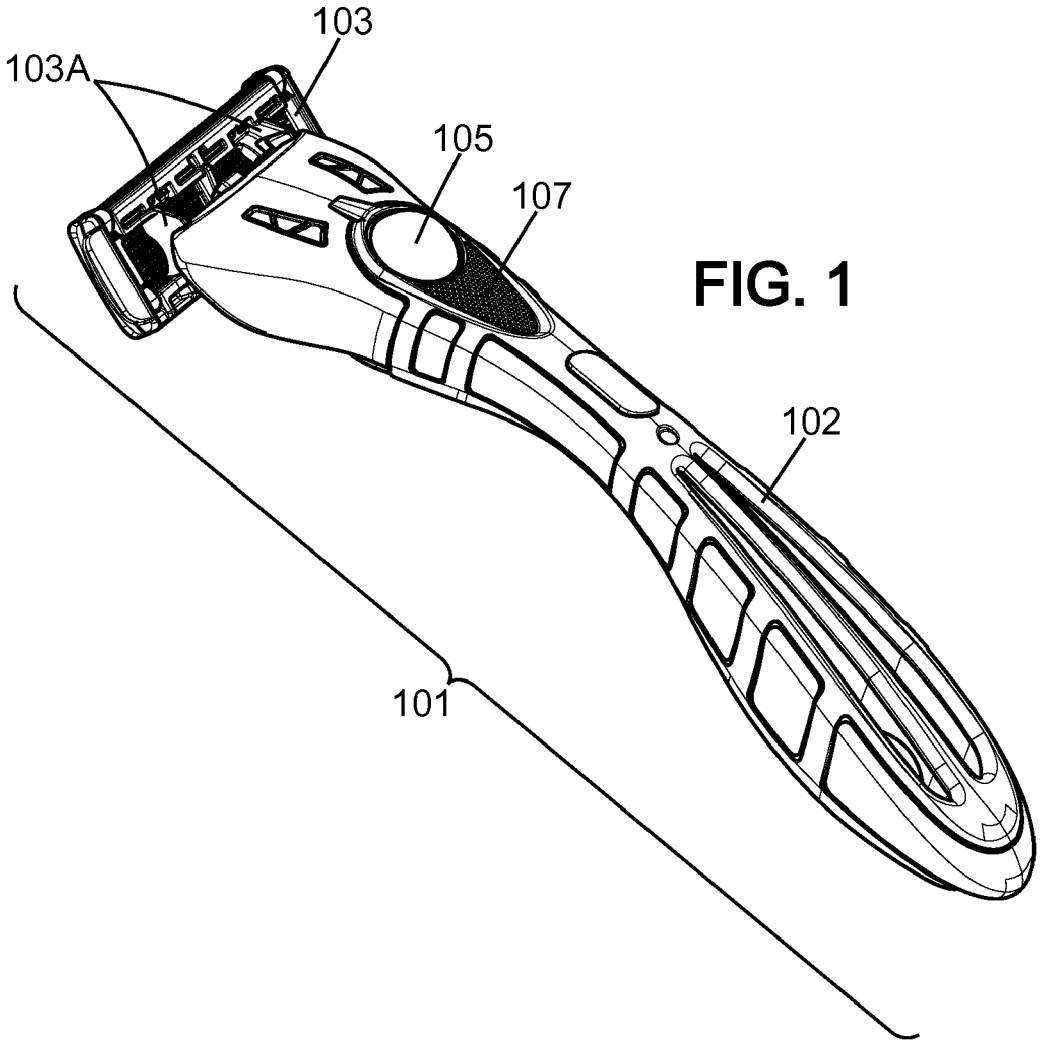
FIG. 1 is perspective view of the shaving razor according to the present disclosure.

FIG. 1 shows one possible embodiment of the shaving razor 101 according to the present disclosure. It includes a handle 102 and a shaving cartridge 103. The cartridge 103 is releasably attached to the handle body 102A, which serves as a gripping area for the user. The handle body 102A may have an elongated shape and can have various designs which are known in the field of shavers. For example, the handle body 102A may include at least one recessed portion and/or at least one insert. The handle body 102A can be manufactured from any suitable material such as plastic, or metal, or their combination. In order to improve the gripping characteristics of the handle 102, it may further include one or more rubber areas. The handle may include a support 104 attachable to the handle body 102A, for example by press-fitting. The handle body 102A is made as one piece. An inner partially hollowed area may be provided in the handle body 102A for placing components related to the lock and release mechanism of the handle 102. The individual components of the lock and release mechanism will be described in more detailed later. The handle 102 may further be provided with a button 105.

The shaving razor 101 is adapted for use with disposable razor cartridges. The shaving razor 101 may be provided with a pair of arms 106. The arms 106 are adapted to engage and disengage the razor cartridge 103. For example, the two arms 106 may be movable between a rest position, in which the cartridge 103 is attached to the handle 102, and a release position, in which the two arms 106 come closer together, thereby releasing the razor cartridge 103 from the handle 102. The pair of arms 106 may generally extend in the XY plane as illustrated on FIG. 3. (An alternate embodiment can have the arms as a one-piece part to the mechanism where a living hinge designed to allow for the needed arm movement connects the left and right arm).

The cartridge 103 may be provided with a pair of hooks 103A. The hooks 103A may be adapted to engage with a pair of shell bearings 106A provided on the arms 106. The shell bearings 106A are adapted to hold the cartridge 103 on the handle 102. The shell bearings 106A and the hooks 103A are adapted to engage with each other and to enable pivotal movement of the cartridge 103 around a pivot axis parallel with the X-axis. Alternatively, the arms 106 may be compatible with an intermediate structure attached to the cartridge 103. The arms 106 then might engage and disengage with the intermediate structure, or both the cartridge 103 and an intermediate structure. The handle 102 may be provided with return means adapted to return the cartridge 103 to a neutral position when the cartridge 103 is rotated upon application of the shaving forces. Other pivoting means, which allow the cartridge 103 to pivot around an axis parallel with X-axis are also possible, for example pins provided on the arms 106 and corresponding holes disposed on the cartridge 103.

Figure 2:
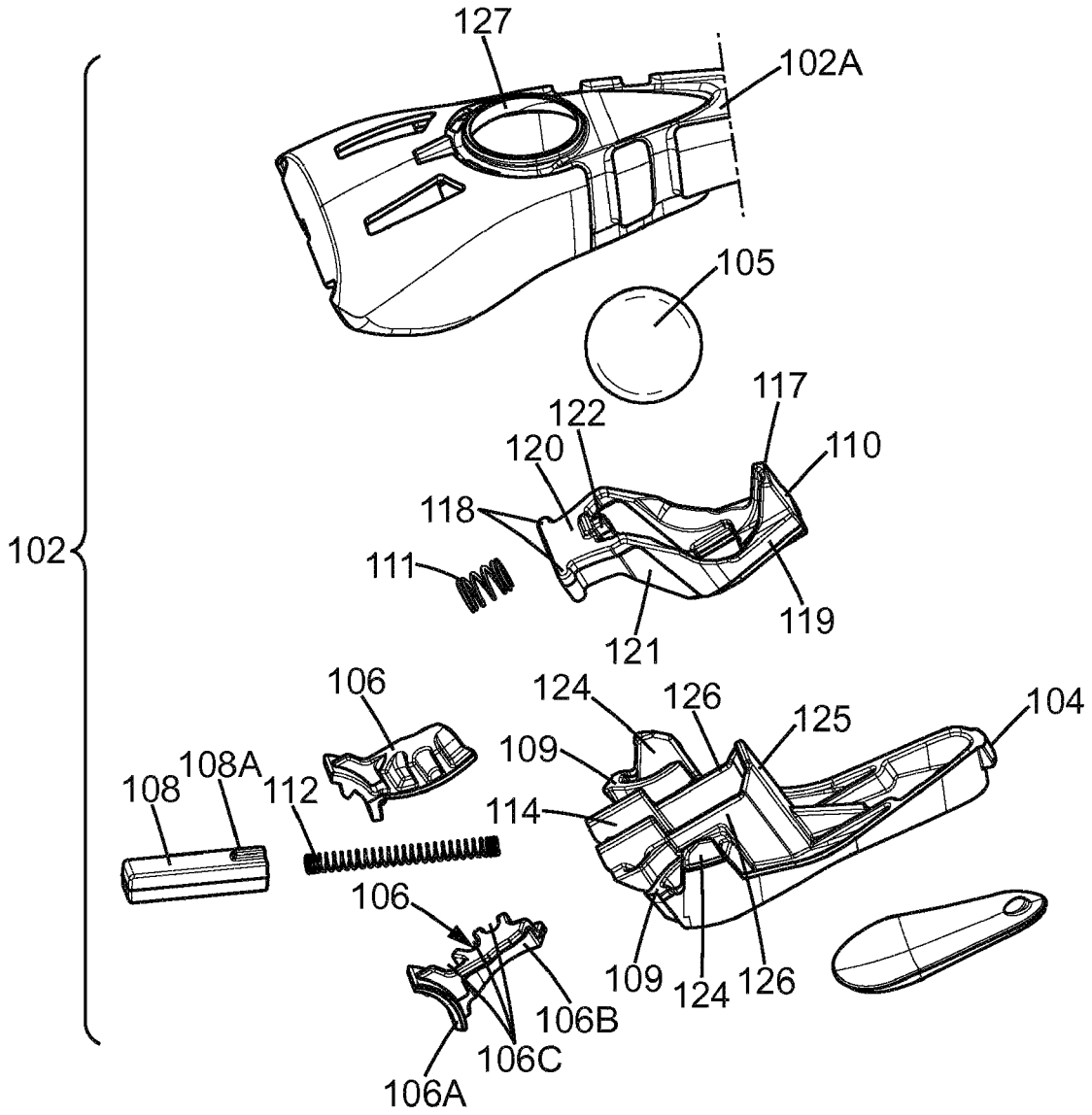
FIG. 2 is an exploded view of the shaving razor of FIG. 1.

When moving from the rest position towards the release position, an elastic return force is applied to the two arms 106 by the return means, so that the arms 106 are indirectly elastically biased towards the rest position (i.e. the return means are generally not in direct contact with the arms 106). In alternative embodiments, at least some of the biasing force may be applied directly on the arms 106 and achieving similar effect. The elastic return force may be generated by a spring, an elastic tongue or similar means. Referring to FIG. 2, an elastic spring 112 may be used in cooperation with a pusher 108. The pusher 108 may include a hollowed portion 108B, in which the elastic spring 112 could be positioned. An advantage of such arrangement with the spring 112 inside the pusher 108 is that it saves space and thus enables the shaver 101 to be either smaller and more compact, or to contain more components, if necessary.

The actuation button 105 shown on FIGS. 1-4 of the accompanying drawings is movably mounted on the handle 102. The button 105 is adapted to be movable between a lifted position and a depressed position. The movement of the button 105 takes place substantially in the upward-downward direction, which is the direction generally perpendicular to the XY-plane as illustrated on FIGS. 3 and 4. The button 105 moves generally perpendicular to the plane in which the arms 106 are extending.

FIG. 2 shows an exploded view of the handle 102. The handle includes a handle body 102A serving as the gripping area for the user to manipulate with the shaver 101. The handle 102 may be provided with a button 105 functioning as a release button for ejecting the cartridge 103 from the handle 102. The button 105 can have any shape adapted to slide along the inclined portion 117 of the driving member 110, such as for example, the button 105 can have a spherical shape. The handle body 102A may include an opening 127, which is adapted to prevent the button 105 from falling out from the handle 102. In case of the spherical shape of the button 105, the opening may have a diameter smaller than the diameter of the sphere. The opening 127 may be coated with rubber or similar material to prevent slipping and/or rotation of the button 105 therein.

A bottom part of the handle 102 is provided with a support 104, which can be, for example, press-fitted to the handle body 102A. This can be achieved via fixing portions 124 disposed on each side of the support 104. More of such fixing portions 124 can be provided on the support 104 if necessary. Other means of mechanical and/or physical attachment of the support 104 with the handle body 102A are also possible. The upper part of the support 104 includes structural arrangement that supports all, or at least most of the components of the lock and release mechanism of the shaver, and other components related to the pivoting of the cartridge 103 on the handle 102.

The support 104 may be made of the same material as the handle, or their combination. The support 104 includes a central area 114 enclosed by a pair of side walls 126 and a back wall 125. As can be seen on FIGS. 3 and 4, the central area 114 serves for positioning the pusher 108. The width of the pusher 108 substantially corresponds with the width between the two side walls 126, such that the pusher 108 is arranged within the central area 114, and such that the pusher 108 is enabled to slide along the side walls 126. The pusher 108 may contain a hollowed portion 108B, in which the spring 112 is positioned. The pusher 108 and the spring 112 represent the return means which are adapted to force the cartridge 103 in the neutral position, whenever the cartridge 103 pivots around the X-axis during shaving. The spring 112 may be partially contained inside the hollowed portion 108B of the pusher 108, such that the first end of the spring 112 faces the inner-most point of the hollowed portion 108B. The second end of the spring 112 could be facing the back wall 125 of the support 104. The cartridge 103 pivoting from the neutral position forces the pusher 108 inside the handle 102 and against the back wall 125, thereby contracting the spring 112 and thus generating the return force, which tends to return the cartridge 103 back into the neutral position.

The pusher 108 can further contain at least two ridges 108A. In the embodiment shown on the drawings, the pusher contains one upper ridge 108A and one lower ridge 108A. As the pusher moves back and forth in the central area 114, the lower ridge may slide in a lower groove 115 of the support 104. Also, the upper ridge 108A may slide in an upper groove 116 provided in a driving member 110.

The driving member could be made of any material such as plastic, or metal. The driving member 110 is interposed generally between the handle body 102A and the support 104. The shape of the handle body 102A and the support 104 is such that they form an inner area of the handle 102, in which the individual components of the lock and release mechanism are located. The driving member 110 is positioned approximately on the support 104, and substantially below the opening 127. The driving member 110 may have a stepped structure, including a top face 120 and a bottom face 119. The top face 120 and the bottom face 119 can be connected via a pair of bridges 121. The top face 120 of the driving member 110 lies substantially in the XY plane and above the bottom face 119. Furthermore, the top face 120 is located closer to the shaving cartridge 103, i.e. the top face 120 does not lie directly above the bottom face 119. The top face 120 is shifted in the forward direction with respect to the bottom face 119. The pair of bridges 121 extends from the top face 120 in the backward direction and downward toward the bottom face 119. The bridges 121 are angled with respect to the XY plane.

At the front part of the upper face 120, there are disposed two projections 118, each from one side of the driving member 110. The projections 118 extend generally perpendicular to the Y-axis in opposite directions. The projections 118 lie in a common plane. This plane could be identical with the plane in which the top face 120 extends. The tips of the projections 118 may have any suitable shape. Such as for example, the tips of the projections 118 are curved outwardly, having a rounded convex shape.

The back portion of the lower face 119 can be provided with an inclined portion 117. One side, for example the back side, of the inclined portion 117 may extend generally upwards from the bottom face 119 in the Z-direction and perpendicularly to the XY plane. An opposite side of the inclined portion 117, may be slanted with respect to the XY plane.

The driving member 110 is also in communication with a biasing spring 111. The biasing spring 111 could be sandwiched between the back wall 125 provided on the support 104 and the back of the top face 120 of the driving member 110. The back portion of the top face 120 may include a stud 122 protruding from the back portion of the top face 120 generally in the backward direction, i.e. in the direction of Y2. The stud 122 may extend approximately in the same plane as the top face 120 of the driving member 110. As can be seen for example on FIG. 3 or 4, the stud 122 is adapted to hold the biasing spring 111 in a proper position between the back wall 125 and the back portion of the top face 120 of the driving member 110.

The biasing spring 111 may be of a cylindrical shape with a circular cross-section. The diameter of the cross-section of the biasing spring 111 may be comparable with the diameter of the stud 122, in case where the stud 122 is also circular in cross section. Alternatively, the stud 122 may be of square cross-section and the diameter of the cross-section of the biasing spring 111 may have similar value as the diagonal of the stud 122. The biasing spring 111 is positioned such that movement of the driving member 110 in the backward direction causes contraction of the biasing spring 111.

Any alternative biasing means could be used instead of the biasing spring 111, for example a compressible pad made of plastic or any elastic material.

Figure 3:
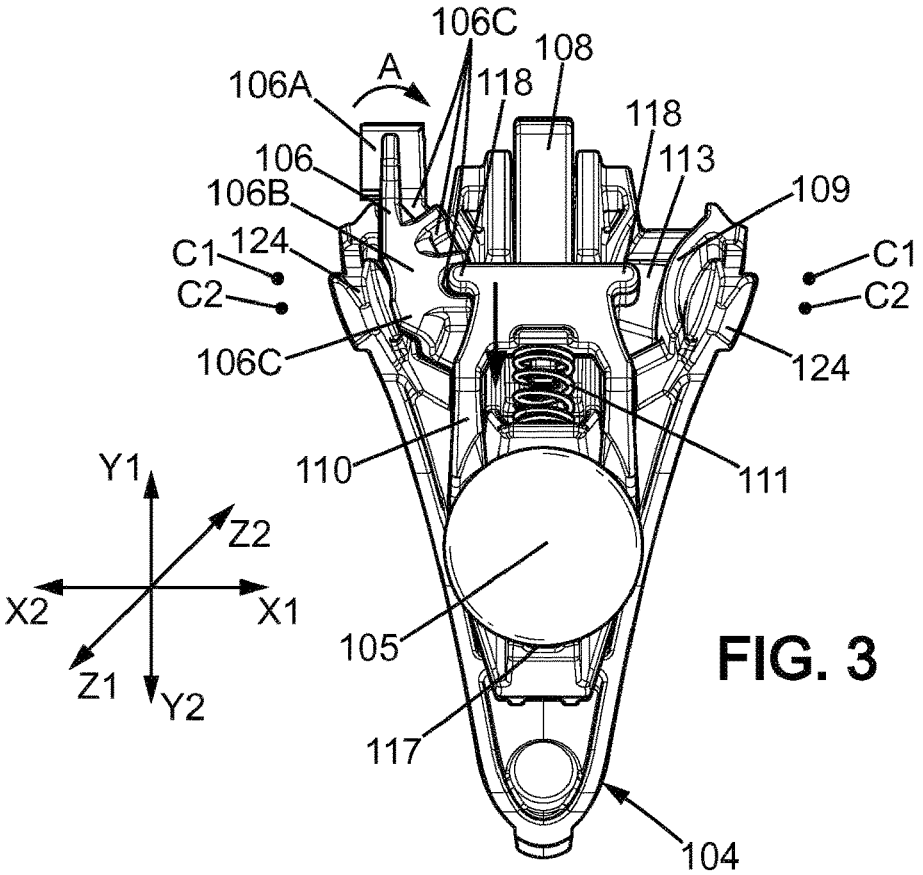
FIG. 3 is a top view of the distal part of the handle.

As best seen on FIG. 3, the support 104 is provided with a channel 113 on each side of the central area 114. Additionally, to each side of the support 104, there are located arcuate guides 109, such that the channels 113 lead between each respective arcuate guide 109 and the side wall 126 of the central area 114. The channels 113 are structured in shape, such that each channel 113 receives a respective arm 106. The arms 106 are movable within the channels 113 generally in the direction of Y-axis. The arms 106 are slidably mounted on a pair of arcuate guides 109. The arcuate guides 109 may have a substantially circular shape having a center of curvature C1. The center of curvature C1 of the arcuate guides 109 is located outside the handle 102.

The arcuate guides 109 can also have an oval shape, regular or slightly irregular. The arcuate guides 109 may have at least two different centers of curvature C1, C2. However, in any case it is required that the arcuate guides 109 enable smooth and undisturbed sliding movement of the arms 106 in the channels 113. When more than one center of curvature is present, all of the centers of curvature C1, C2, can lie outside the handle 102. The arcuate guides can be either curved inwards toward the center of the handle 102, or outwards towards the outside of the handle. The arcuate guides 109 illustrated in the drawings are curved inwards, i.e. they are both protruding towards the central area 114.

The arms 106 may be made of plastic, metal, or any other suitable material. The material forming the arms 106 is rigid and does not flex. The arms 106 may extend symmetrically with respect to the Y-axis. The arms 106 include a main body 106B. The lower side of each main body 106B is adapted to correspond to the shape of the respective arcuate guide 109. Each main body 106B may have generally the same center of curvature C1 as the respective arcuate guide 109. Each side wall 126 of the central area 114 may also be provided with a shape corresponding with the shape of the main body 106B of the respective arm 106, such that the arms 106 are lead in the channels 113 along a predefined track. The arms 106 are separate components from the driving member 110 and/or from the support 104.

The arms 106 may include shell bearings 106A, which are adapted to engage and disengage with the hooks 103A of the shaving cartridge 103.

The main body 106B of the arms 106 may also include at least one recess 106C. The recess 106C is adapted to receive a projection 118, such that it provides an interlocking mechanism between the driving member 110 and the respective arm 106. This connection between the driving member 110 and each respective arm 106 results in simultaneous movement of these components. By connecting the projection 118 with the recess 106C, whenever the driving member 110 slides backwards, the driving member 110 pulls the arms 106 backwards. Analogically, when the driving member slides forward, the driving member 110 pushes the arms 106 forward.

The button 105 is positioned between the driving member 110 and the handle body 102A. The button 105 partially protrudes outside the handle body 102A, so that the user is enabled to push the button 105 inside the handle 102. The button 105 could be made of plastic, metal, or any other suitable material, or their combination. The button 105 may also be partially covered with rubber or similar material to enhance the feeling and comfort for a user when operating the button 105. The button 105 may have any suitable shape, such as for example the button 105 can be in the shape of a sphere. The button 105 can also have pyramidal or trapezoidal cross-section in the YZ plane. The shape of the button 105 and the shape of the inclined portion 117 of the driving member 110 are constructed in a way that pushing the button 105 inside the handle 102 causes the driving member 110 slide backwards.

When a user is about to disengage cartridge 103 from the handle 102, he/she pushes the button 105. The button 105 cooperates with the driving member 110, such that as the button 105 moves downward, the driving member 110 is pushed backwards by the button 105. When the button 105 is fully pressed into an actuated position, the button 105 is seated on the lower face 119 of the driving member 110, abutting the inclined surface 117 on a back side of the button 105 and abutting the pair of bridges 121 on its front side of the button 105.

As the button 105 is actuated, the driving member 110 slides backwards. By means of the connection between the driving member 110 and the arms 106 via the pair of projections 118 and the corresponding recesses in the arms 106, the arms 106 slide backwards inside the channels 113, each time the driving member 110 slides backwards.

In combination with the sliding movement of the driving member 110 along the Y-direction, the presence of the arcuate guides 109 makes the arms 106 turn along the X-direction, as the driving member is slid along the Y-direction. Therefore, upon pushing the actuation button 105, the arms 106 turn inwards toward the central area 114 into a release position—disengaging the handle 102 from the cartridge 103, and the arms 106 turn to the sides of the handle 102 into a lock position as the button 105 is released by the user, thus engaging the handle 102 with the new/replaced cartridge 103.

Alternatively, the construction of the lock and release mechanism of the handle 102 may be such that the arms 106 turn outwards towards the sides of the handle as they move into the release position, and such that the arms 106 turn inwards toward the center of the handle 102 as they move into the lock position. This configuration is applicable in case of the embodiments having the arcuate guides 109 curving outwards, i.e. away from the center of the handle 102.

In any case, the movement of the arms 106 is two-fold, consisting of two components. First, the arms 106 follow the sliding motion of the driving member 110 along Y-axis. Second, the arms 106 perform movement in the direction of X-axis, i.e. they are either closing to each other or moving more apart.

FIG. 3 is an illustration of the release mechanism from the top side. It shows the direction of movement of the driving member 110 upon the actuation of the button 105. FIG. 3 also depicts, how the arm 106 moves during the actuation of the button 105 (the arrow A). It can be seen that as the driving member 110 slides backwards, the driving member 110 cause the biasing spring 111 to compress, so that when the button 105 is released, the driving member 110 is pushed back in its original position by the spring 111. The biasing spring 111 can be substituted by any other suitable return means having adequate elasticity. Appropriate constructional modifications might be required in that case.

Figure 4:
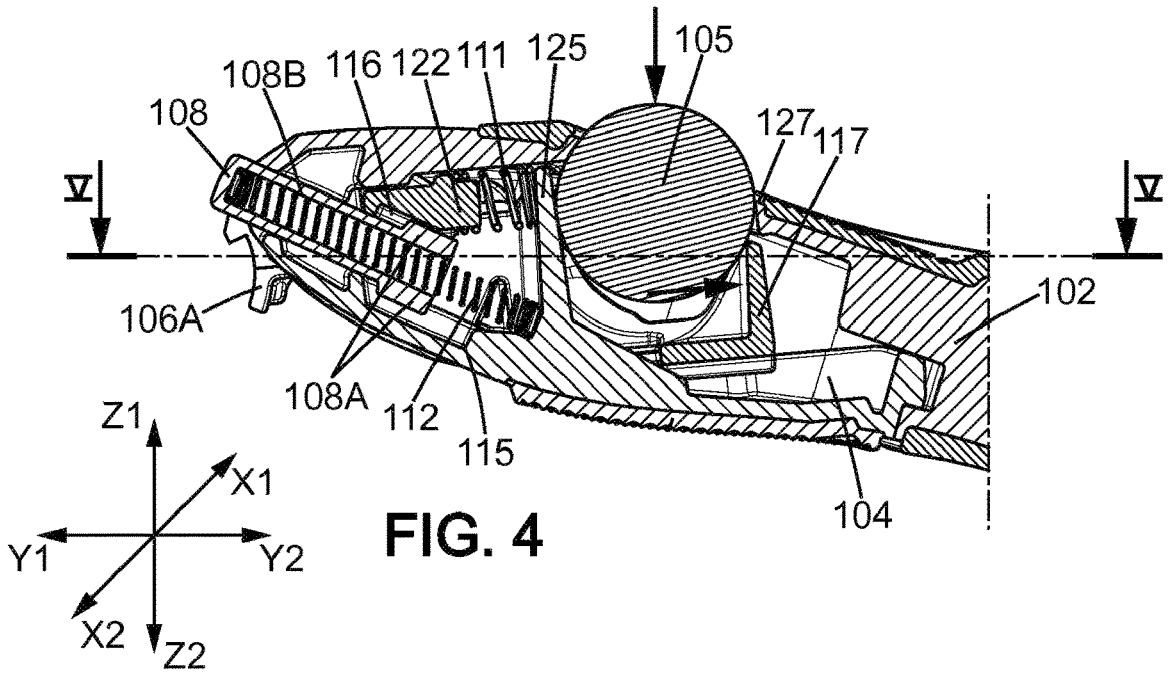
FIG. 4 is a cross-sectional view of the distal part of the handle of FIG. 3.

FIG. 4 shows the operation of the release mechanism from a side. It illustrates both the direction of movement of the button 105 and the corresponding direction of movement of the driving member 110.

Figure 5:
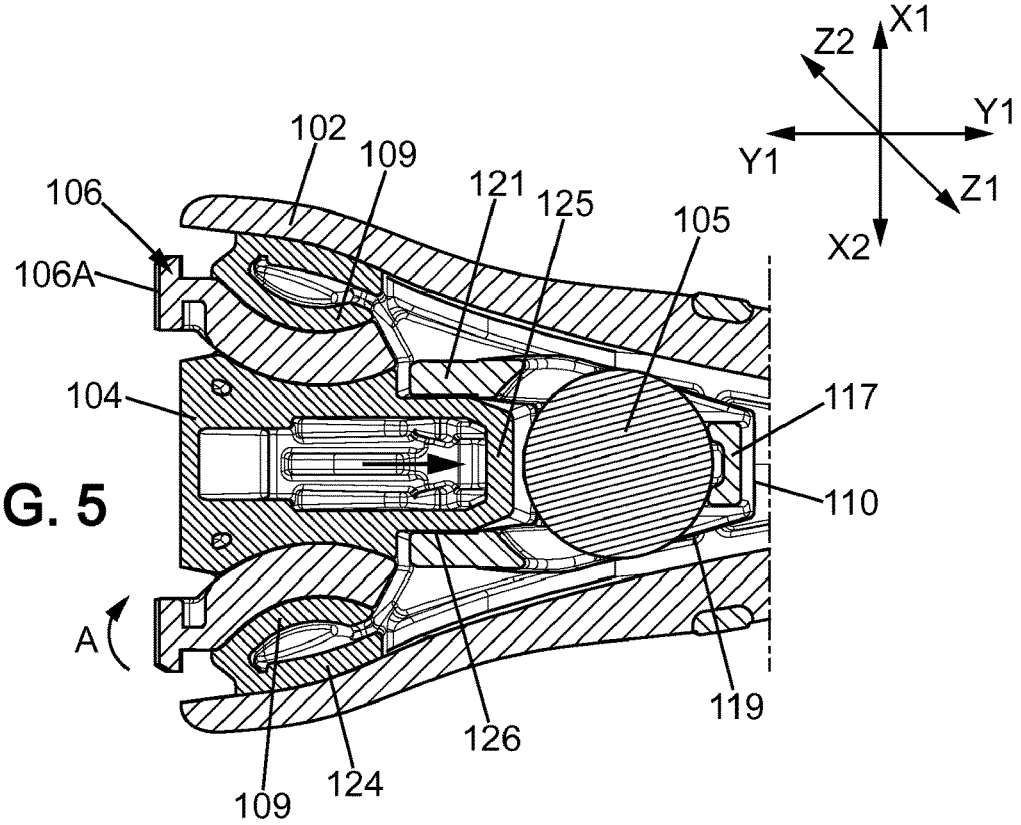
FIG. 5 is a cross-sectional view along the line V of FIG. 4.
Figure 6:
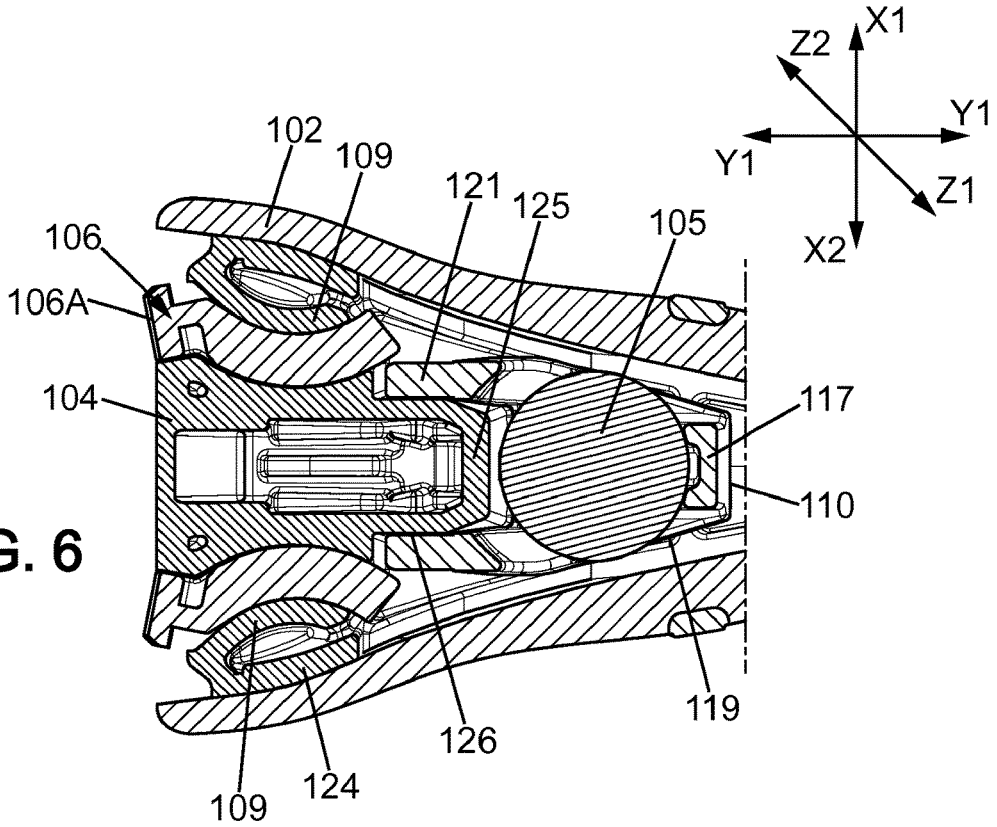
FIG. 6 is an analogue of FIG. 5 with the arms in the release position.

FIGS. 5 and 6 are cross-sectional views of the release mechanism taken along the line V of the FIG. 4. FIG. 5 shows the arms 106 in the lock position engaging the cartridge 103 (not shown in the figure) and FIG. 6 is showing the arms 106 in the release position.

The present arrangement of the arms 106 sliding along the arcuate guides 109 increases safety of the product by the fact that when the cartridge 103 is about to be released from the handle 102, the driving member moves backwards in Y2-direction. On the other hand, when some external forces are applied to the cartridge 103, pulling the cartridge 103 away from the handle 102, the driving member is caused to move forward, i.e. in the direction of Y1, which is opposite to the direction of Y2. Pulling the cartridge 103 from the handle 102 thus implies the arms 106 moving away from each other, i.e. even more into the lock position. Consequently, whenever there are some external forces causing an unwanted release of the cartridge 103 from the handle 102, the connection between the arms 106 and the cartridge 103 is strengthened.

The invention claimed is:

1. A handle for a shaving razor adapted to releasably engage with a razor cartridge, the handle comprising:

a handle body;

a pair of arms;

a support including a pair of arcuate guides; the pair of arms being slidably mounted along the arcuate guides and the arcuate guides being shaped to slidably receive the pair of arms; and a driving member;

the pair of arms being movably mounted on the support between a lock position and a release position and elastically biased toward the lock position, the pair of arms being adapted to engage the razor cartridge when the pair of arms are in the lock position, and to disengage the razor cartridge when the pair of arms are in the release position, each of the pair of arms extending from a proximate end of the handle closer to the support to a distal end of the handle further away from the support;

the driving member being slidably mounted on the support between the pair of arms and being connected to the pair of arms such that sliding the driving member in a first direction moves the pair of arms towards the distal end of the handle on the arcuate guides and turns the pair of arms toward the lock position, and sliding the driving member in a second direction moves the pair of arms towards the proximate end of the handle on the arcuate guides and turns the pair of arms toward the release position.

2. The handle according to claim 1, wherein each one of the pair of arms includes a main body positioned between the handle body and the support, and shell bearings extending outside the handle and being adapted to engage with the razor cartridge.

3. The handle according to claim 2, wherein the shell bearings extend away from each other in opposite directions and perpendicularly to the first direction, such that when the pair of arms are moved in the first direction along the arcuate guides the shell bearings move away from each other, and when the pair of arms are moved in the second direction along the arcuate guides the shell bearings move towards each other.

4. The handle according to claim 1, wherein the pair of arms and the arcuate guides have complementary surfaces facing each other enabling engagement of the pair of arms with the arcuate guides, such that each one of the pair of arms keeps contact with the corresponding arcuate guide when each one of the pair of arms slides on the support.

5. The handle according to claim 1, wherein the support further includes a pair of channels for receiving, respectively, each one of the pair of arms, each channel providing guidance for the pair of arms, when moving to and from the release position.

6. The handle according to claim 1, wherein each one of the pair of arms includes at least one recess, and the driving member, at a front end closer to the razor cartridge, includes a pair of complementary projections, the recess being adapted to receive at least one of the pair of complementary projections, such that each one of the pair of arms is capable of being pulled in the second direction and pushed in the first direction.

7. The handle according to claim 6, wherein a tip of each one of the pair of complementary projections of the driving member has a curved convex shape, and wherein the recess of each one of the pair of arms in which the corresponding projection is engaged has a curved concave shape, complementary to the shape of the pair of projections.

8. The handle according to claim 1, wherein the pair of arms and the driving member are separate from the support, and wherein the pair of arms and the driving member are separate from each other.

9. The handle according to claim 1, wherein each of the arcuate guides has a center of curvature and the center of curvature of the arcuate guides lies outside the handle body.

10. The handle according to claim 1 further including a biasing member, the biasing member generating a return biasing force as the pair of arms move towards the release position and as the driving member is moved in the second direction, the return biasing force urging the pair of arms in the lock position by forcing the driving member in the first direction.

11. The handle according to claim 10 further including a button adapted to be pressed downwards in a direction perpendicular to a plane formed by the pair of arms, the button being adapted to cooperate with the driving member, such that when the button is pressed downwards, the driving member is forced to move in the second direction by the button, moving the arms into the release position, and the biasing member being adapted to force the driving member to move back in the first direction and move the pair of arms into the lock position, once the button is released by a user.

12. The handle according to claim 11, wherein the driving member includes an inclined surface located at a back thereof, such that the button, when actuated, slides along the inclined surface, thereby forcing the driving member to slide in the second direction, such that the pair of arms are moved in the release position.

13. The handle according to claim 11, wherein the button is in the form of a sphere.

14. A shaving razor comprising the handle according to claim 1 and a razor cartridge mounted on the handle, the razor cartridge being engaged by the pair of arms when the pair of arms are in the lock position and the razor cartridge being disengaged from the pair of arms when the pair of arms are in the release position, the razor cartridge being released from the handle upon actuation of a button disposed on the handle body.

* * * * *